United States Patent [19]

Suter

[11] 4,078,653

[45] Mar. 14, 1978

[54] ROTARY PISTON CONVEYOR WITH A MINIMUM OF TWO ROTORS

[75] Inventor: Alois Suter, Im Holeeletten 29, 4054 Basel, Switzerland

[73] Assignee: Alois Suter, Basel, Switzerland

[21] Appl. No.: 723,386

[22] Filed: Sep. 15, 1976

[30] Foreign Application Priority Data

Sep. 24, 1975 Switzerland ..... 12418/75

[51] Int. Cl.[2] ..... B65G 33/18

[52] U.S. Cl. ..... 198/625; 198/663; 198/674; 418/201

[58] Field of Search ..... 198/662, 663, 672, 674, 198/608, 625; 418/107, 201, 203; 74/409, 424.7

[56] References Cited

U.S. PATENT DOCUMENTS

| | | | |
|---|---|---|---|
| 1,677,980 | 7/1928 | Montelius | 418/203 |
| 1,762,708 | 6/1930 | Allred | 418/201 |
| 1,915,579 | 6/1933 | Owens | 418/107 |
| 2,369,539 | 2/1945 | Delamere | 418/203 |
| 2,683,994 | 7/1954 | Whitfield | 418/201 |
| 3,037,396 | 6/1962 | Martin | 74/409 |
| 3,151,806 | 10/1964 | Whitfield | 418/201 |
| 3,198,132 | 8/1965 | Zalis | 418/201 |
| 3,549,000 | 12/1970 | Christian et al. | 198/625 |
| 3,580,389 | 5/1971 | Nonnenmacher | 198/625 |

FOREIGN PATENT DOCUMENTS

| | | | |
|---|---|---|---|
| 844,854 | 6/1970 | Canada | 74/409 |
| 235,456 | 8/1964 | Germany | 418/201 |
| 1,007,131 | 10/1965 | United Kingdom | 418/201 |

*Primary Examiner*—Evon C. Blunk
*Assistant Examiner*—Richard K. Thomson
*Attorney, Agent, or Firm*—Lawrence Rosen; E. Janet Berry

[57] ABSTRACT

A rotary piston conveyor comprising a plurality of interengaged rotors in which at least one rotor is driven and, in turn, drives the other rotors. Each pair of adjacent rotors have spiral vanes which mesh to form the conveyor path as the rotors rotate. The degree of interengagement of the flanks or edges of the meshed vanes determine the efficiency of the conveyor path formed by the meshed vanes for any particular material or groups of material. Hence the rotors are adjustable to vary the interengagement of the vanes. The clearance between vanes in a direction parallel to the shaft determines the size or cross-section of the conveyor path. Hence, the rotors are longitudinally adjustable with respect to each other to vary the clearance. The adjustment device includes a split gear on the driven rotor and means for making each of the two adjustments as well as markings or indicia which may be read against a marker to show the degree of adjustment.

6 Claims, 4 Drawing Figures

ROTARY PISTON CONVEYOR WITH A MINIMUM OF TWO ROTORS

The present invention relates to a rotary piston conveyor with a minimum of two feed screw rotors so arranged that the clearance between the threads of adjacent screws can be adjusted to meet the requirement of different products.

BACKGROUND OF THE INVENTION

Pumps in the form of feed screws are known for their conveyance of fluid continuously without formation of foam. These screw pumps contain a drive screw supported in the intake and discharge chambers and one or several secondary screws.

Such pumps or feed devices comprise meshing or opposing screws having constantly converging threads supported in an "S"-shaped housing. One screw is power driven. The secondary screw or screws are usually driven by the thread flanks or edges of the main screw at a higher driving force or ratio. They may also be driven by a gear connection to the shaft of the main screw. The axial forces resulting from the pressure build up of the conveyed fluid are usually taken up by a roller or axial sleeve bearing supported on the drive screw.

Screw pumps or feeds of this design have the drawback that it is not possible to adjust the clearance between the threads in accordance with the properties of the transported material, since a sufficiently large range of clearances is not available. Thus it is impossible, for instance, to transport plastic materials filled with quartz powder.

BRIEF DESCRIPTION OF THE INVENTION

The rotary piston or screw conveyor of the present invention does not suffer from this drawback and is designed so that the rotors or screws having opposing but otherwise equal pitch and similar profiles, have clearances between their flanks or overlying edges exceeding the fabrication tolerances as well as especially means to adjust these flank clearances.

The primary object of the present invention, therefore, is the provision of a screw feed system comprising at least a pair of interfingered parallel longitudinal screws in which at least one of the screws may be longitudinally and laterally adjusted to vary the clearance or bite of the screws with respect to each other and the width of the channel therebetween.

Figure 1:
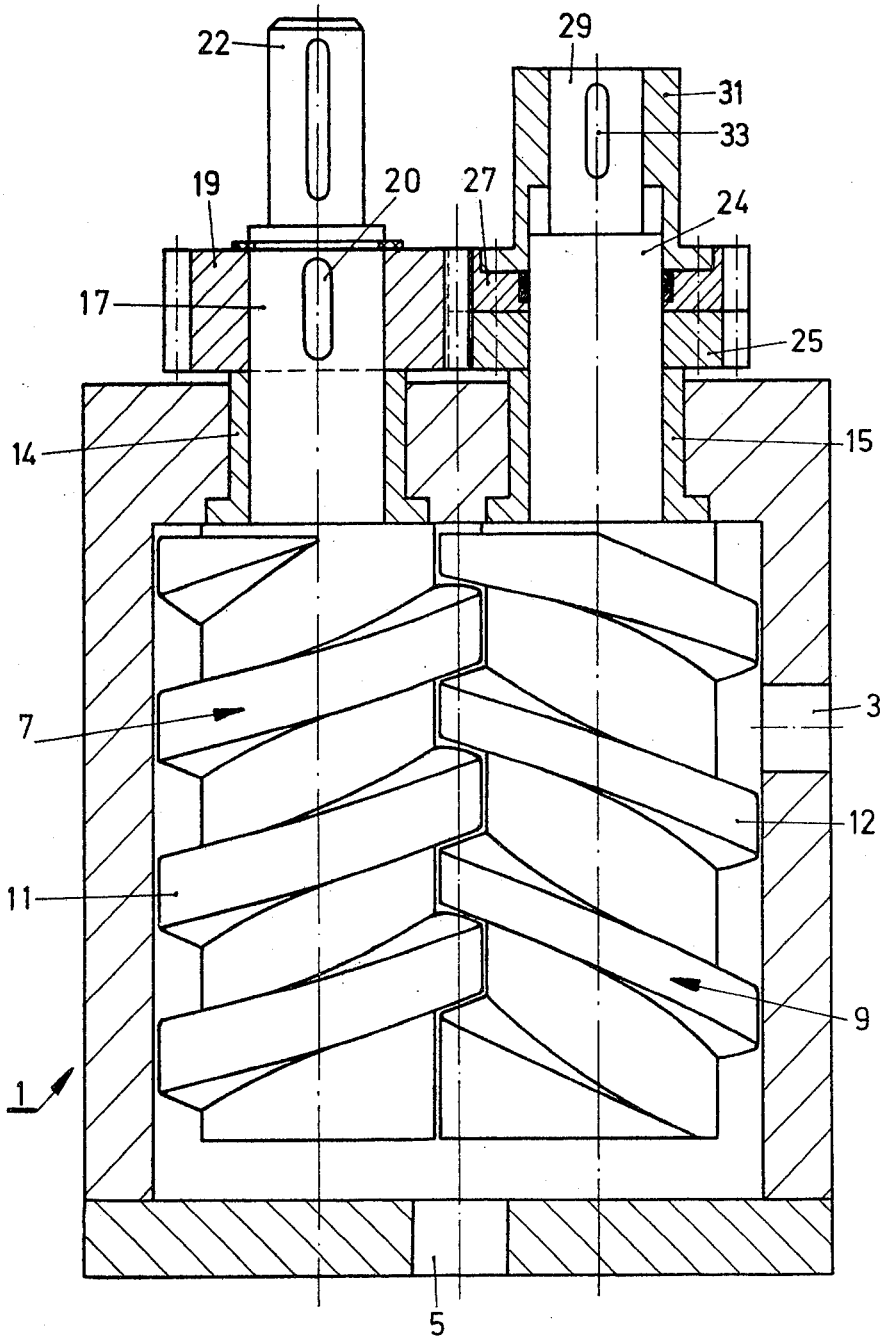
Figure 2:
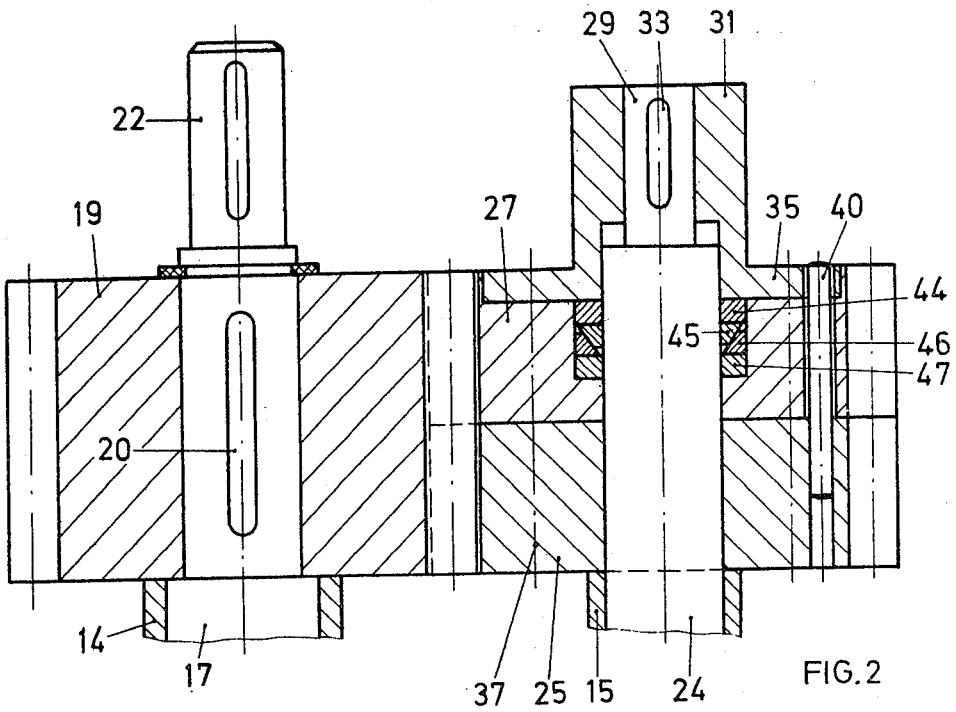
Figure 3:
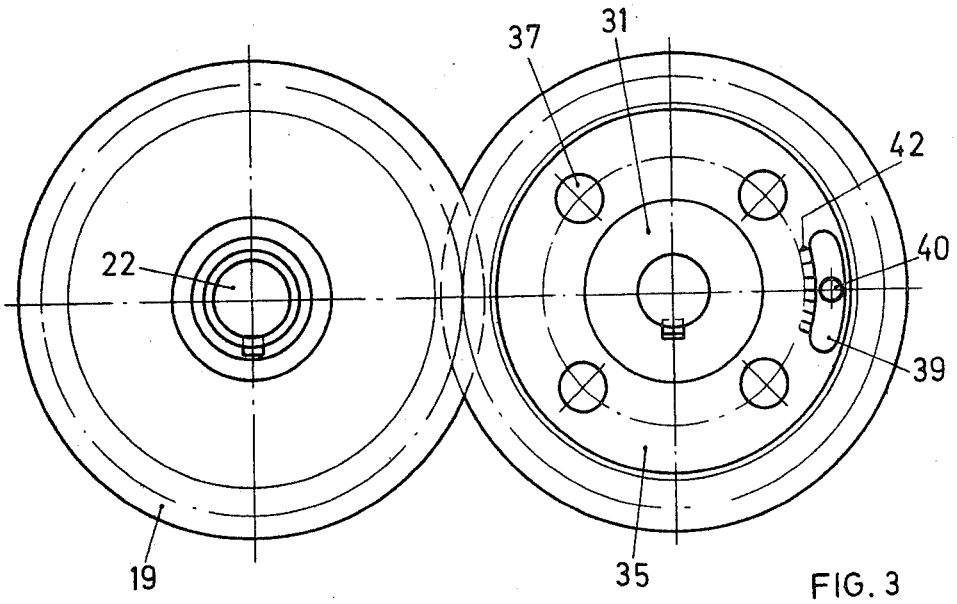
Figure 4:
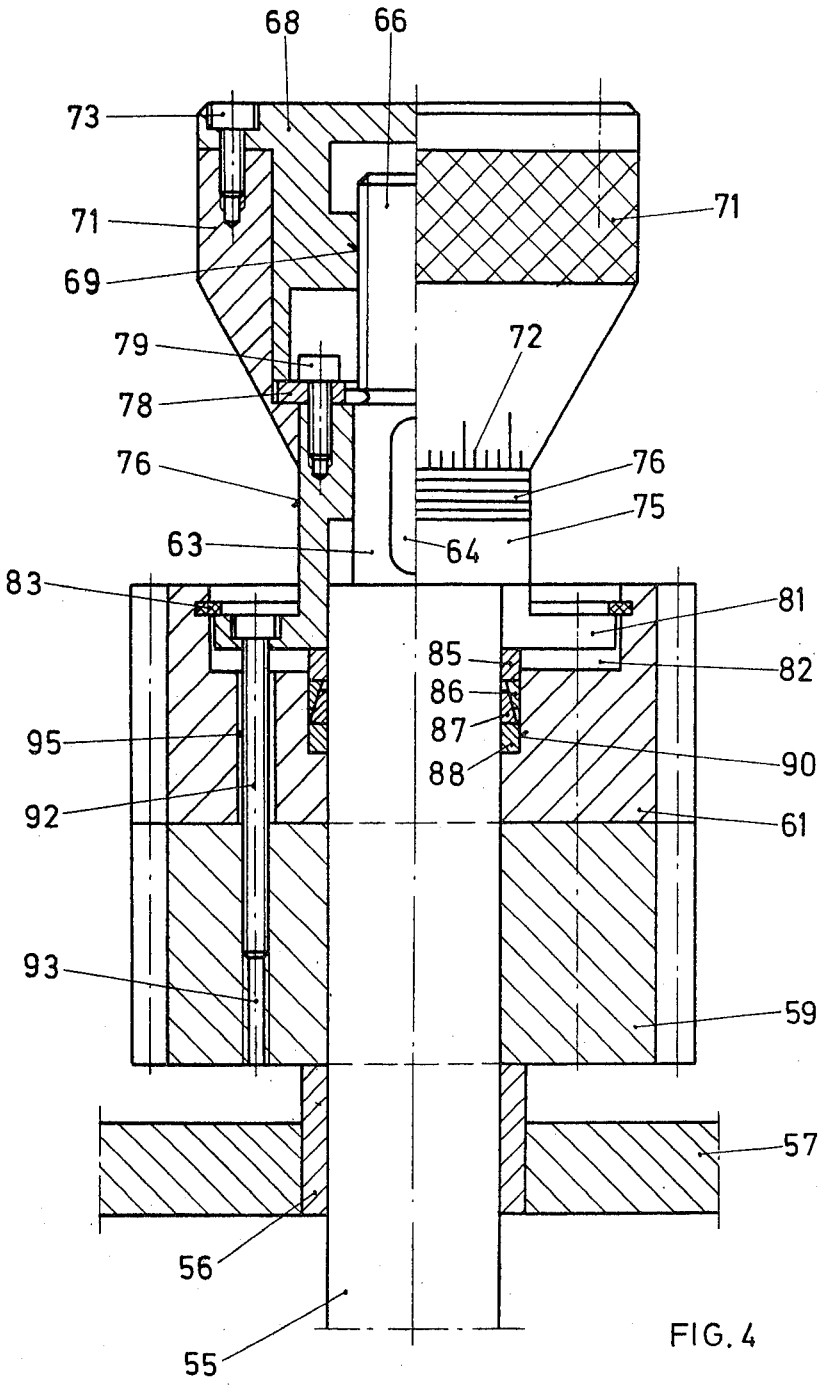

The foregoing and other objects of the present invention will become apparent in the following description and drawings in which:

FIG. 1 is a longitudinal section view of a rotary piston screw conveyor with two threaded rotors for the transport of liquids, FIG. 2 is an enlarged detail view of the upper end of FIG. 1 showing the drive end of the rotor, FIG. 3 is a top view of the structure of FIGS. 1 and 2, FIG. 4 is a schematic view of a modified form of the drive and adjustment member of the structures shown in FIGS. 1 and 2.

Referring first to FIG. 1, the pump housing of the rotary piston conveyor here shown has an intake opening 3 and a discharge opening 5. A main rotor 7 is supported in housing 1. Rotor 7 may be driven by any suitable drive member such as an electric motor connected to shaft end 22. A secondary rotor 9 extends next to and parallel with rotor 7 with which it meshes and has an opposing but otherwise equal pitch and similar profile as the main rotor 7. Profiles, or threads or vanes 11 and 12 of respective rotors 7 and 9 differ in that profile or thread or vane 12 of secondary rotor 9 is somewhat smaller than profile or thread or vane 11 of main rotor 7; therefore after installation both rotors 7 and 9 exhibit a noticeable flank or interpolated edge clearance that substantially exceeds the normal fabrication tolerances.

The main rotor 7 is supported by means of a shaft 17 and a bushing 14 which is fitted with a main gear 19, as shown in FIG. 1. The latter is joined with shaft 17 by means of a wedge 20. The free end 22 of the shaft is used for mounting a suitable driven wheel or pulley actuated by an appropriate driver as previously mentioned.

The secondary rotor 9 also has a shaft 24 supported in a bushing 15. The extension of the bearing of shaft 24 is used for the attachment of two meshing gears 25 and 27 of equal width. Straight or helical gears may be used. The projecting shaft end 29 is fitted with a control sleeve 31. The control sleeve 31 is firmly attached to shaft end 29 by means of a wedge 33.

As shown in FIG. 2, the control sleeve 31 is fitted with flange 35 which is fastened to the inner mating gear 25 by means of screws 37, represented by their center lines and head circles (FIG. 3). As shown subsequently in the analogous structure of FIG. 4 in greater detail, the top gear 27 has a corresponding bore with greater clearance. A notch 39 is cut into flange 35 through which indicator pin 40, fastened to mating gear 27, penetrates inner mating gear 25 with a clearance corresponding to notch 39 in flange 35. The flange 35 is provided with scribe marks or indicia 42 to register with indicator pin 40 and to show the setting or clearance of rotor 9 relative to rotor 7. In a corresponding recess of mating gear 27, four lock rings 44, 45, 46 and 47 are inserted. When the screws 37 are tightened, these lock rings due to their shape and the material selected embrace shaft 24 by means of flange 35 and thus establish a frictional joint between mating gears 25 and 27 and shaft 24 or secondary rotor 9, respectively.

In the case of the rotary piston or screw conveyor illustrated in FIGS. 1–3, by holding main rotor 7 stationary, secondary rotor 9 can be turned with respect to rotor 7 so that the full flank clearance affects one side or the other of the intermeshing flanks or edge of the vanes of the rotor. It is also possible to adjust the clearance on both sides correspondingly, in which case of course the sum of both flank clearances equals the total flank clearance between both profiles or vanes. Such an adjustment within the limits of the flank clearance of the rotors is, naturally, possible only if the gear flank clearance of gears 19, 25, and 27 is at least as large as the flank clearance of the rotors.

After the flank clearance between rotors 7 and 9 has been adjusted according to the fluid to be transported, it is necessary to fix primarily the clearance between the gear teeth in the direction of transport in which the axial stress is exerted, which for the tooth profiles of the gears of the quality used can be relatively large. If the clearance at the corresponding flanks is not reduced, the adjustment of the clearance between rotors 7 and 9 becomes ineffective. Thus mating gear 27 is rotated with respect to mating gear 25 until the teeth clearance between gears 19 and 27 in the drive direction disappears, i.e. the corresponding tooth flanks mesh without play or any undesirable back-lash. The set flank clearance in the drive direction between rotors 7 and 9 is then effectively maintained. This establishes between main rotor 7 and secondary rotor 9 a partially form-locking and partially force-locking joint, since by tightening screws 37 flange 35 presses on lock rings 44–47 and these are compressed against the outer wall of the recess in mating gear 27 and also against shaft 24. Since the control sleeve 31 forms the form-locking joint with shaft 24 by means of wedge 33 and this control sleeve 31 is also fastened to mating gear 25 through flange 35 and screws 37, and indicator pin 40 to mating gear 27, scribe marks or indicia 42 show the extent of the clearance for secondary rotor 9 with respect to main rotor 7 in one direction or the other referred to a center position and which exists between the flanks of both rotors 7 and 9.

Another embodiment or modification is shown in FIG. 4. The design of the rotary piston conveyor is analogous to the design of FIGS. 1–3. FIG. 4 shows the stub of a shaft 55 to the corresponding secondary rotor (not shown); said shaft 55 being supported in a bushing 56 in a housing 57. There are further two mating gears 59 and 61 engaging a main gear (not shown) which corresponds to main gear 19. The end of shaft 63 is fitted with a groove and wedge 64, followed by a set screw 66. A cap screw 68 with inner thread 69 matching the thread of set screw 66 is joined by means of screws 73 with a measurement drum 71, whose lower conical part is inscribed with a dial 72 or other appropriate indicia. A control sleeve 75, inscribed with graduations 76 corresponding to the indicia on dial 72, is fastened with screws 79 to retainer 78. Retainer 78 is used to join the measurement drum 71 axially with cap screw 68. Control sleeve 75 is fitted with flange 81 which is inserted into opening 82 of mating gear 61 and is held axially by means of a circlip 83 as shown. In this case also lock rings 85, 86, 87, and 88 are provided, which, based on their shape and/or on the material used, when compressed are capable of forming a force-locking joint between shaft 55 and mating gear 61. These lock rings are positioned in a circular groove 90 of mating gear 61. The flange 81 is butted against mating gear 59 by means of threaded bolts 92 and thus ensures the force-locking joint with shaft 55, as above described. Bolts 92 are screwed into the threaded holes 93 of mating gear 59, whereas in their upper part they are inserted in adequately oversized through-holes 95 in mating gear 61, which permit the mating gears 59 and 61 to rotate relative to each other.

Also for this design the teeth clearance between the main gear and the mating gears or, respectively, play between the rotation of main and secondary rotors can be eliminated by turning both mating gears 59 and 61 with respect to each other within the range of their tooth flank clearance with the main gear, without affecting hereby the position of the secondary and main rotors. This turning of both mating gears 59, 61 with respect to each other is made possible by the appropriately dimensioned clearance between through-hole 95 and threaded bolt 92. It is also possible to modify the flank clearance between both rotors by keeping the main rotor fixed and turning the secondary rotor so that the highest possible flank clearance is distributed between the front and rear flanks, as above described.

To accomplish this, measurement drum 71 is turned together with screw cap 68. Since the screw cap 68 is axially attached by means of retainer 78, turning measurement drum 71 causes an axial displacement of set screw 66 and jointly of shaft 55 with the secondary rotor. Thus the rotor play can be appropriately adjusted. The adjusted value can be read off scales 72 and 76.

After eliminating the tooth flank clearance between the main and the mating gears, threaded bolts 92 are tightened to establish the force-locking joint between mating gears 60 and 61 and shaft 55 by compressing lock rings 84–88 against shaft 55.

It should be noted that in the case of the embodiments of rotary piston conveyors herein described by maintaining an opposing but otherwise equal pitch for the main and secondary rotor, the screw threads of the main rotor are machined for instance with a minus tolerance and the screw threads of the secondary motor with a plus tolerance, such that the sum of the tolerances is much larger than the normal range of machining tolerances.

Rotary piston conveyors or screw pumps that can be adjusted in accordance with the present invention are suitable for instance for the transport free of pulsations of thermosetting molding compounds enriched with abrasive fillers. Thus 1000 g of resin compound, evenly modified with 270 parts quartz powder with a grain size of 60 $\mu$m and which at 20° had a viscosity of 150 P could be transported without problems. A partial sample of 50 $cm^3$ of this resin compound was poured on a dry glass plate of 20 mm diameter and examined after a setting time of 2 min.

The layer of plastic compound remaining on the glass plate was measured with a caliper in three places: in the center of the glass plate and at points 5 mm from the rim. The average layer thickness amounted to 0.14 mm.

The flank clearance appropriate for this mixture of 0.14 mm play between the screw threads was set on the adjustment device shown in FIGS. 1 and 2.

At a throughput of 4000 $cm^3$/min, a two-rotor screw pump that had been adjusted as described was used for 3 hours to process a plastic molding compound modified with quartz powder at a constant working pressure of 50 atm. A posterior inspection of the disassembled pump parts did not show any abrasion marks on the thread flanks of main and secondary rotor.

In the foregoing, the invention has been described in connection with illustrative embodiments thereof. Since many variations and modifications of the present invention will now be obvious to those skilled in the art, it is preferred that the scope of this invention be defined, not by the specific embodiments herein contained, but only by the appended claims.

I claim:

1. A rotary piston conveyor for conveying materials having different viscosities comprising:

at least two axially extending rotors each of which is provided with a continuous helical vane, the vanes of adjacent ones of said rotors being of opposite hand and substantially equal pitch so as to be cooperable in meshing relation to convey material within the channels formed between said vanes;

a drive gear on one of said rotors and a pair of gears on each of the rotors cooperable therewith, a first of each said pair of gears being drivable by said drive gear and selectively frictionally connectable with its associated rotor for rotation therewith, the second of each said pair of gears being carried by the associated rotor for rotation therewith;

fastening means for locking said first and second gears to each other;

and locking means carried by each said first gear interposed between same and the associated rotor, said locking means being shiftable to effect said frictional connection between the first gear and its associated rotor when said first and second gears are brought into locking relation by said fastening means;

whereby the clearance between flank portions of cooperable rotor vanes may be regulated in accordance with the viscosity of the material to be conveyed by movement of one rotor relative to the other and rotation of the first gear relative to the second gear may be performed to eliminate backlash with the drive gear subsequent to establishment of the desired clearance between the rotor vanes.

2. The rotary piston conveyor of claim 1 in which the clearance between the tooth flanks of said drive gear and said first and second gears is at least as large as the flank clearance of the respective rotor vanes.

3. The rotary piston conveyor of claim 1 in which one rotor is displaceable in a longitudinal direction with respect to the cooperable rotor to thereby vary the conveyor space between the vanes of the respective rotors.

4. The rotary piston conveyor of claim 1 in which one of the rotors carries indicia on which the value of the clearance between the cooperable rotors can be read.

5. The rotary piston conveyor of claim 1 in which the thickness of the vanes of cooperable rotors are different.

6. The rotary piston conveyor of claim 1 in which said first gear is formed with an annular recess adjacent the rotor and said locking means comprises a plurality of superposed locking rings positioned within said recess, at least two of said locking rings having engageable inclined surfaces whereby to permit axial movement of said locking rings along the rotor and within said recess.

* * * * *